United States Patent [19]

Edholm et al.

[11] Patent Number: 4,722,445

[45] Date of Patent: Feb. 2, 1988

[54] LENGTH SEPARATOR

[75] Inventors: Thomas Edholm, Staffanstorp; Ulf Ståhl, Höllviken, both of Sweden

[73] Assignee: Kamas Industri AB, Vellinge, Sweden

[21] Appl. No.: 786,296

[22] Filed: Oct. 10, 1985

Related U.S. Application Data

[63] Continuation-in-part of Ser. No. 690,824, Jan. 11, 1985, abandoned, which is a continuation of Ser. No. 470,521, Feb. 28, 1983, abandoned.

[30] Foreign Application Priority Data

Mar. 3, 1982 [SE] Sweden ..... 8201296

[51] Int. Cl.[4] ..... B07B 13/05; B07C 5/00

[52] U.S. Cl. ..... 209/687; 73/861.73; 209/546

[58] Field of Search ..... 209/44.1, 44.3, 1, 509, 209/546, 549, 552, 600, 684, 687, 243, 233, 245, 246; 222/56, 59, 63; 73/861.41, 861.73; 364/478, 479, 502, 555; 340/606, 609, 673, 611

[56] References Cited

U.S. PATENT DOCUMENTS

| | | | |
|---|---|---|---|
| 2,135,343 | 11/1938 | Johnson | 209/687 |
| 2,997,175 | 8/1961 | Gordon | 364/479 |
| 3,154,824 | 11/1964 | Dietert | 209/243 |
| 3,606,745 | 9/1971 | Girodat | 209/1 |
| 3,612,273 | 10/1971 | Pritchett | 209/687 |
| 3,860,804 | 1/1975 | Rutman | 364/555 |
| 4,004,289 | 1/1977 | Kirk | 340/606 |
| 4,440,029 | 4/1984 | Tomiyasu et al. | 73/861.73 |

FOREIGN PATENT DOCUMENTS

| | | | |
|---|---|---|---|
| 2140782 | 1/1973 | France . | |
| 2437653 | 4/1980 | France . | |
| 55-145942 | 11/1980 | Japan . | |
| 1137777 | 9/1966 | United Kingdom . | |
| 1384882 | 2/1975 | United Kingdom | 73/861.73 |
| 128814 | 11/1959 | U.S.S.R. . | |
| 740303 | 9/1978 | U.S.S.R. . | |
| 0899130 | 1/1982 | U.S.S.R. | 209/233 |

OTHER PUBLICATIONS

Brochure entitled "Hart Uni-Flow No. 32 and No. 33 Grain Separators, Hart Indented Cylinder", No Date.

Brochure entitled "Hart Uni-Flow No. 22SG Cylinder Separator", 9-1981.

Article entitled "The Principles and Practice of Seed Cleaning: Separation with Equipment that Senses Dimensions, Shape, Density and Terminal Velocity of Seeds", 1977.

*Primary Examiner*—Johnny D. Cherry
*Assistant Examiner*—Donald T. Hajec
*Attorney, Agent, or Firm*—Merchant, Gould, Smith, Edell, Welter & Schmidt

[57] ABSTRACT

A length separator comprising at least one rotational member, e.g. a disc or a cylinder, having cells for lifting seeds and other particles from a lower position to a higher position, and a trough for receiving the lifted material. The rotatable member is associated with at least one sensor located in the flow of the lifted material supplied to the trough, for generating an electric signal in dependence on impingement of material particles leaving the rotatable member and falling down into the trough. The sensor is operatively connected through an electronic function unit to adjusting means for controlling the flow of material to be cleaned which is supplied to the separator, in dependence on the impingement intensity.

3 Claims, 8 Drawing Figures

LENGTH SEPARATOR

Figure 1:
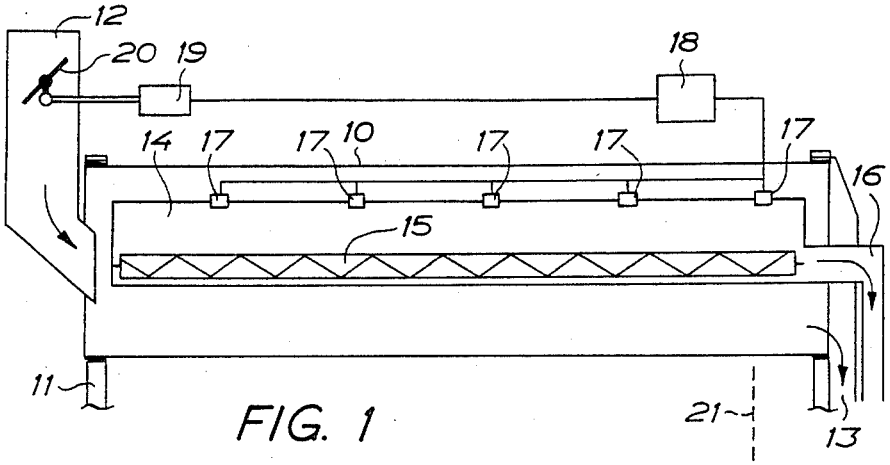

This application is a continuation-in-part application of Ser. No. 690,824 filed Jan. 11, 1985, now abandoned, which is a continuation of Ser. No. 470,521 filed Feb. 28, 1983, now abandoned.

The invention relates to length separators comprising at least on rotatable member e.g. a disc (indent disc separator) or a cylinder (indent cylinder separator), which is indented to form cells or pockets for lifting seeds and other particles from a lower position to a higher position, and a trough for receiving the seeds or particles lifted by means of the rotatable member. Such separators are used for grading particles having the same width and thickness but different lengths, e.g. in order to remove from grain and other ssed contaminants such as half kernels, admixture of foreign culture seeds and weed seeds, and make possible a sharp and exact separation according to length also at relatively small length differences between the particles.

It is important to utilize optimally the capacity of the separator, which means that the material flow through the separator at each time should be as large as possible without reducing the cleaning efficience to such degree that the good product contains too large a portion of the particles to be separated in the separator. Since it is desired to utilize the full capacity of the separator, it is rather tempting to feed into the separator a flow which is larger than the flow that can be received by the separator with an acceptable efficiency. Then, the quality of the good product may be reduced, because not all particles considered as an impurity in the grain, will be separated in the separator but will be carried along by the good product as a remaining contaminant therein.

The purpose of the invention is to provide a separator of the type referred to above, in which the cleaning efficiency is controlled automatically in relation to the cleaning result aimed at.

In order to achieve this purpose the invention provides a length separator comprising at least one rotatable member forming cells for lifting seeds and other particles from a lower position to a higher position, a trough for receiving the seeds or particles lifted by means of the rotatable member, at least one sensor located in the flow of the lifted material supplied to the trough for generating electric signals in dependence on impingement of material particles leaving the rotatable member and falling down into the trough, an electronic function unit, and adjustment means for adjusting the flow of material to be cleaned which is supplied to the separator, the sensor being connected to the adjusting means through the function unit to control said flow in dependence on the impingement intensity.

Preferably, a length separator for grain material according to the invention comprises a length separator for grain material comprising a rotatable cylinder, an inlet for grain material at one end of the cylinder and an outlet for grain material at the other end of the cylinder, said cylinder being indented for form cells for lifting particles forming part of said grain material, from a lower position to a higher position, a trough inside the cylinder extending substantially along the length thereof, a sensor located to sense the flow of lifted material supplied to the trough adjacent the outlet end of the cylinder for generating an electric signal in dependence on impingement of particles leaving the rotatable member and falling down into the trough, an electronic function unit, and adjustment means for adjusting the flow of material through said inlet, the sensor being connected to the adjusting means through the function unit to control said flow in dependence on the impingement intensity.

Figure 2:
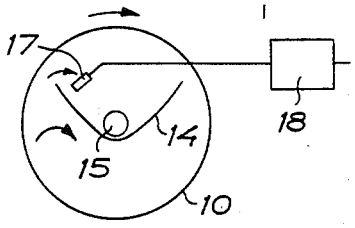
Figure 3:
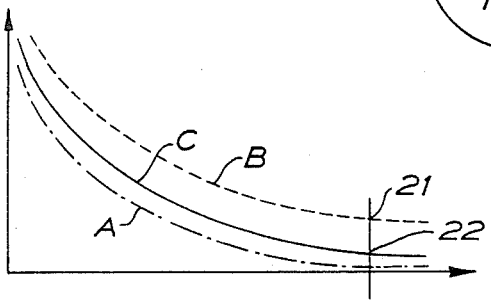
Figure 4:
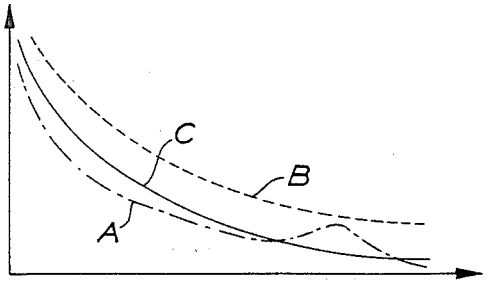
Figure 5:
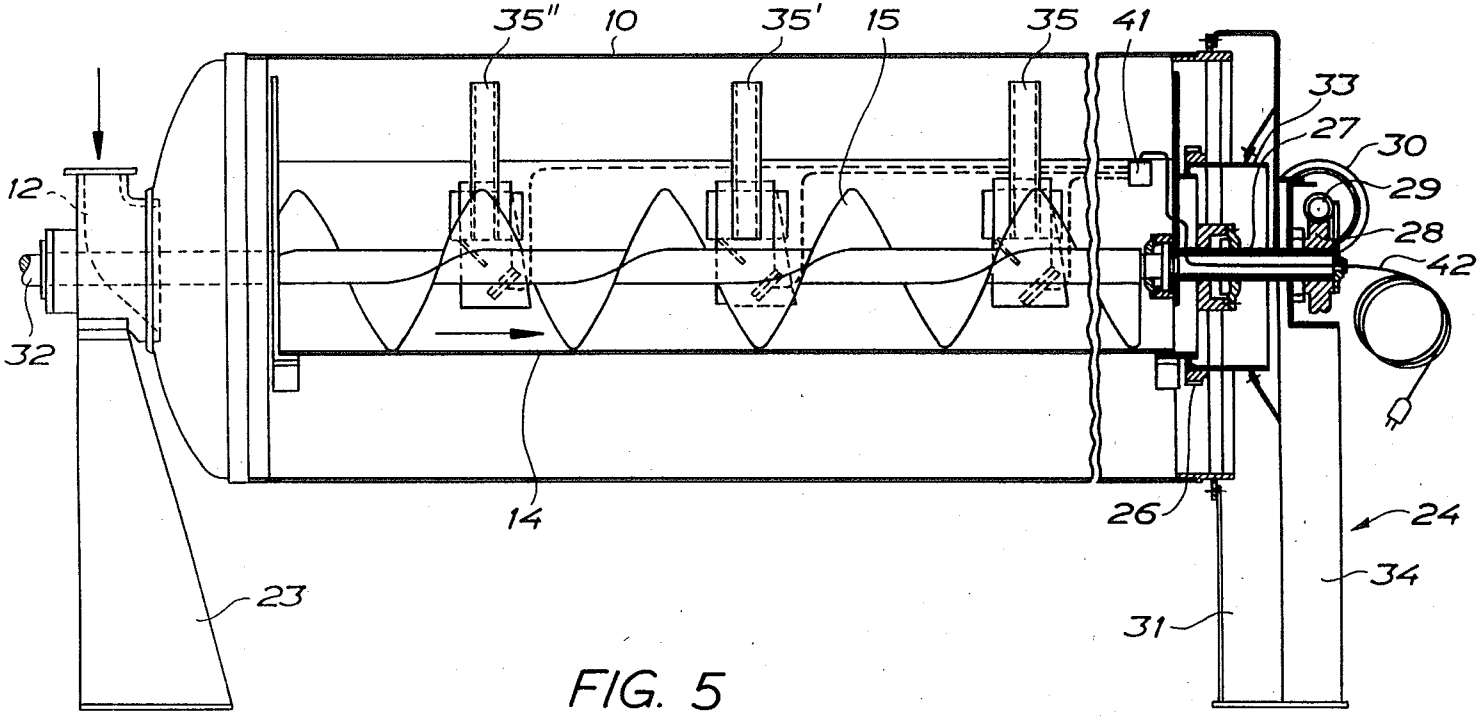
Figure 6:
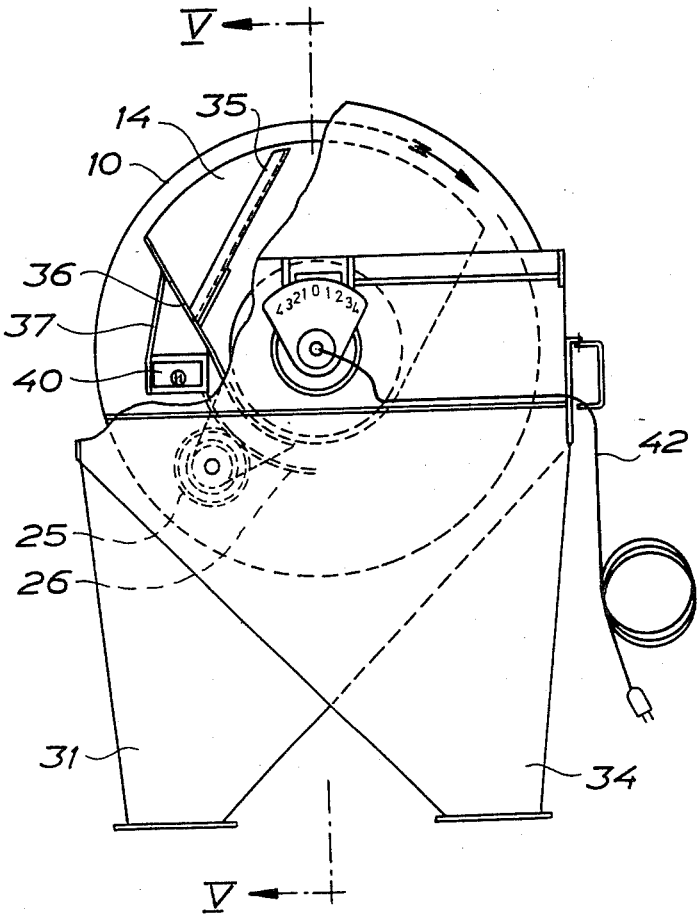
Figure 7:
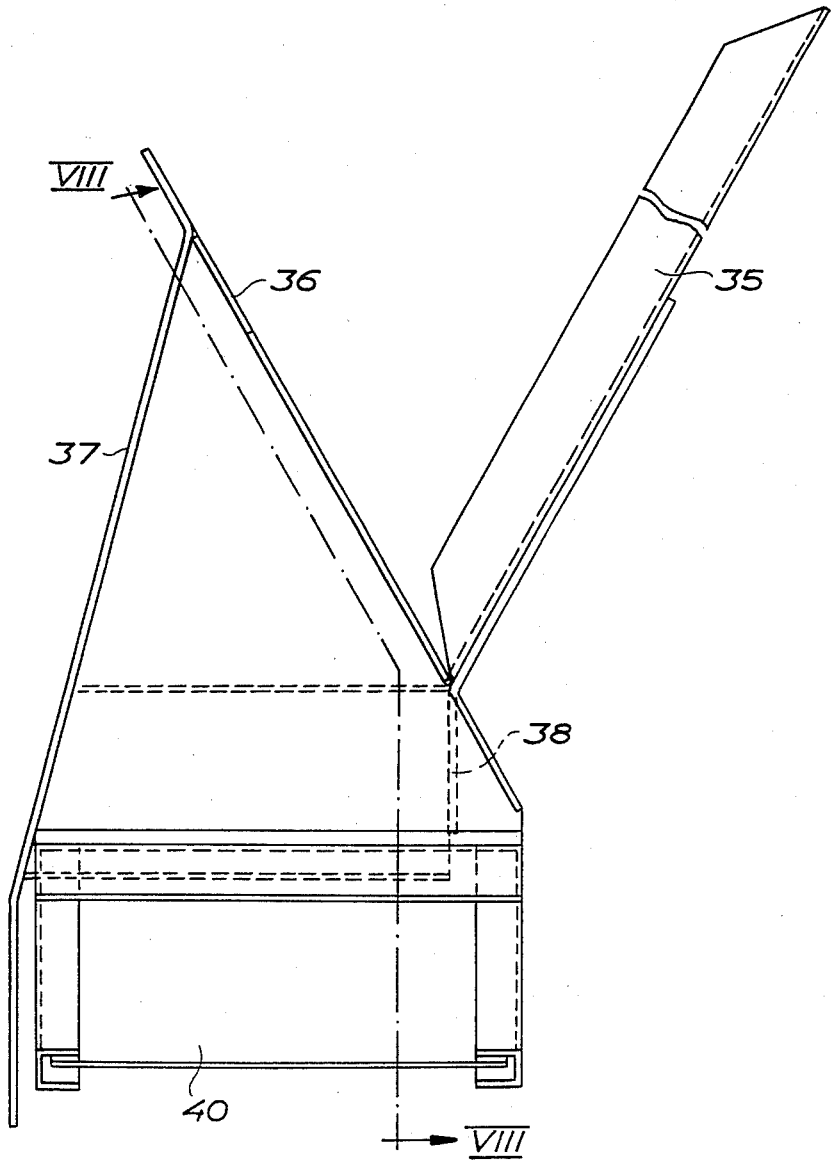
Figure 8:
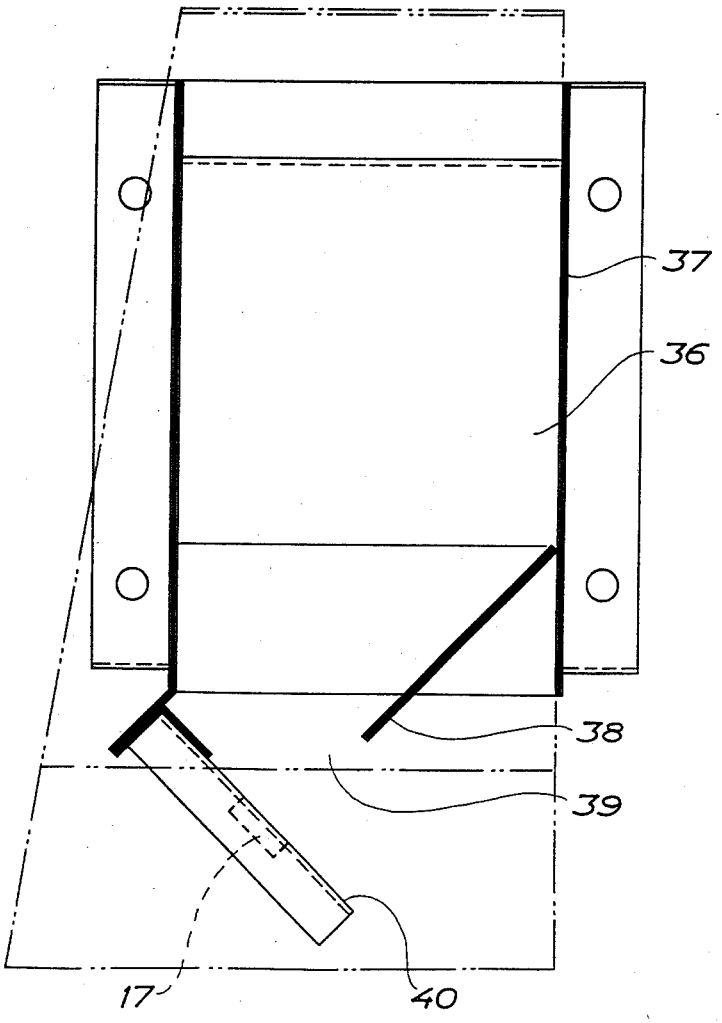

The invention will be described in more detail below reference being made to the accompanying drawings in which FIG. 1 is a diagrammatic longitudinal sectional view of an indent cylinder separator according to the invention, FIG. 2 is a diagrammatic cross-sectional view of the separator in FIG. 1, FIGS. 3 and 4 are graphs showing the distribution of the flow of separated particles over the length of the separator, FIG. 5 is a longitudinal sectional view, taken along line V—V in FIG. 6, partly a side view, of a preferred embodiment of an indent cylinder separator of the invention, FIG. 6 is an end view, partly a cross-sectional view of the separator in FIG. 5, FIG. 7 is an enlarged side view of a sensor arrangement in the separator of FIGS. 5 and 6, and FIG. 8 is an enlarged cross-sectional view of the sensor arrangement, taken along line VIII—VIII in FIG.7.

The length separator can be of an embodiment previously known per se, and therefore the constructive details thereof are not shown in FIG. 1 and 2. The incident length separator shown therein comprises a cylinder 10 of steel sheet which has on the inside of the curved wall thereof indentation in a regular pattern, which forms cells or pockets. The cylinder is rotatably mounted in a frame 11 and is connected to a drive motor for the rotation thereof. At one end of the cylinder an inlet 12 is provided for the supply of the material to be cleaned in the separator, and at the opposite end an outlet 13 is provided for this material when the material has passed through the cylinder 10 from one end to the other. The cylinder can be arranged horizontally or more or less inclined from the inlet end to the outlet end. The inclination can be adjustable. Inside the cylinder, an axially extending stationary trough 14 is provided, having a screw conveyor 15 at the bottom thereof, and this trough has an outlet 16 to which material supplied to the trough, is forwarded by the conveyor 15 which is connected to a suitable drive motor. In a known manner, the cylinder can be provided with a stirrer, so-called ultrameans, and with different types of damming-up members for the control of the flow of material along the cylinder.

When the cylinder 10 is being rotated e.g. in clockwise direction as seen in FIG. 2, and grain containing as contaminants half kernels, weed seeds, etc., which are short while the grain kernels are long, kernels as well as seeds will be received by the cells or pockets on the inner surface of the curved wall of the cylinder and will be carried up from the lower region of the cylinder where the raw material supplied is located, towards the upper region of the cylinder. On their way up, the long kernels then soon fall out of the cells or pockets while the short particles will be carried along by the cylinder upwards to the upper region of the cylinder where they are discharged from the cells or pockets and fall down into the trough 14. The cleaning efficiency then can be controlled by adjusting the flow of raw material through the inlet 12, e.g. by the inlet being provided with a feed roll with variator. Usually, the trough 14 is mounted for pivotal movement about the longitudinal axis thereof so that the position of the trough can be adapted to different types of goods to be cleaned.

The separator comprises a sensor 17 located in the flow path of the material falling down from the cells or pockets into the trough 14. This sensor is located in the region at the outlet end of the separator and can comprise e.g. a piezoelectric element, a differential transformer, or a dynamic pick-up. Any other type of sensor can be provided; the main thing is that the sensor generates an electric signal when particles are impinging on same and that the magnitude of the electrical signal from the sensor is related to the flow of particles impinging on the sensor. The signal from the sensor 17 is supplied to an electronic unit 18 wherein the signal is passed via an amplifier, a filter and a digitizing circuit to a micro-processor which compares the signal obtained with upper and lower nominal values set by the operator. If the signal does not fall within the limits set, a difference signal is supplied by the micro-processor to an adjusting means 19 such as a hydraulic or pneumatic cylinder or an electromechanical adjuster, which is connected to a throttle 20, a feed roll or similar flow controlling means in the inlet 12, for adjusting the flow rate of material to be cleaned, which is supplied to the separator, to such a value that the signal from the sensor is brought into agreement with the nominal value set in the micro-processor. The adjustment can also take place in dependence on the measured interval between two hits following one upon the other, which are registered by the sensor.

The unit 18 will not be described in detail, since the average man skilled in the art of electronics at the present state of the art would be able to design suitable circuits and circuit components for achievement of the function described above.

Referring to the graph in FIG. 3, a flow of material to be cleaned, which is supplied to the separator and the rate of which is at or below the capacity of the separator, will provide a flow to the trough, which decreases progressively along the length of the cylinder according to the dot and dash line curve A. However, if more material to be cleaned is supplied than should be received by the separator, this flow will follow the dash line curve B, which means that the amount of separated material is considerable also at the outlet end of the cylinder. Therefore, it can be expected that there is still in the good product discharged through the outlet 13, a proportion of the material that should have been separated in the separator but has not been separated due to the fact that too much material is allowed to pass through the separator per time unit.

However, optimal conditions would prevail if the flow of separated material followed the solid line curve C and thus it is the task of the unit 18 to adjust the supply of material to be cleaned at such flow rate that this curve will be followed. If it can be assumed that the sensor 17 is located at the place marked by the line 21 in FIG. 3, the upper limit for the flow should correspond to a point somewhat over the point 22, and the lower limit for the flow should correspond to a point somewhat below the point 22, or one limit value can correspond to the point 22 and the other one to a point somewhat over or below the point 22.

As will be realized, the flow of material including contaminants and defect kernels from the cylinder 10 to the trough 14 is sensed by the sensor 17 inside the separator at a location close to the outlet 13 for the good product and that the material in the cylinder at this location should be substantially free from such contaminants. This is true only if the separator has been operated with a flow of material supplied at the inlet 12, which can be fully cleaned by the separator when the material flows from the inlet 12 to the outlet 13. The fulfillment of this condition is indicated by the sensor being hit by substantially no particles. However, no signal from the sensor may also indicate that there is no flow through the separator or that the capacity of the separator is not fully utilized so that the material supplied is fully cleaned at a position located at a substantial distance from the outlet 13. Accordingly, the limit values of the unit 18 have to be adjusted empirically in order to achieve optimal utilization of the separator with due consideration of the material to be cleaned and the purity of the this material, because different types of material generate different numbers of hits against the sensor when the flow rate of separated material is on the curve corresponding to acceptable purity of the good product.

Since there is some delay in the adjustment of this flow rate when the flow of supplied goods to be cleaned has been changed, the unit 18 can be arranged to supply control pulse at intervals corresponding to the delay.

Also other operational parameters affecting the cleaning efficiency, e.g. the inclination of the trough 14 about the longitudinal axis thereof (angular positon), the rotational speed of the cylinder 10, the longitudinal inclination of the cylinder, the position and/or rotational speed of the stirrer, and the adjustment of the damming-up members, must be adjusted with regard to the goods to be cleaned. The curve A can have another form than that shown in FIG. 3, e.g. the form shown in FIG. 4 wherein the irregularity close to the outlet end of the cylinder may be the result of a malfunction of some kind e.g. incorrect distribution of the mass of material in the separator. This can be corrected by arranging several sensors 17 which are distributed along the trough 14 in the longitudinal direction thereof, the signals obtained from these sensors in the function unit 18 being compared with a mathematic model representing the curve C of desired paremeters for the generation of a control signal by which the conditions as to the operation of the separator, represented by the curve C, will be obtained. In this way, the cleaning in the separator will be held under complete control.

It should be noted that the sensor or sensors 17 sense an internal flow in the separator in order to indicate the degree to which the capacity of the separator is being utilized under the operation of the separator.

The invention so far has been illustrated with relation to an indent cylinder separator, but according to the most generic scope thereof it can be applied also to separators having rotatable discs indented to form cells or pockets, termed indent disc separators.

The indent cylinder separator shown in FIGS. 5 and 6 includes a cylinder 10 which is indented in the usual manner to form cells or pockets. The cylinder is rotatably mounted at each end thereof in floor stands 23 and 24 and is connected to a drive motor to be rotated in clockwise direction as seen in FIG. 6. A pinion 25 on the drive motor engages a tooth gear 26 mounted to the cylinder. A trough 14 is mounted inside the cylinder, and a shaft 27 connected therewith is provided with a worm wheel 28. A worm 29 engages with the worm wheel 28 and is provided with a hand wheel 30 allowing pivotal adjustment of the trough 14 about the longitudinal axis thereof. In the floor stand 23 there is provided an inlet 12 for the goods to be cleaned in the separator at one end of the cylinder, and the other stand 24 forms a outlet conduit 31 for material discharged from the cylinder at the other end thereof. A screw conveyor 15 is rotatably mounted in the trough 14, and the shaft 32 thereof is connected to a drive motor not shown in the drawings. The screw conveyor forwards material supplied to the trough during operation of the separator in the manner described above, to an outlet sleeve 33 on the cylinder, which supplies the material to an outlet conduit 34 also formed by the floor stand 24. As will be realized, the indent cylinder separator of FIGS. 5 and 6 principally is constructed and operates as described with reference to FIGS. 1 and 2.

The arrangement of the sensor provided also in the embodiment of FIGS. 5 and 6, is shown in more detail in FIGS. 7 and 8.

A chute 35 formed by a channel, extends into the trough 14 at the left side thereof, as seen in FIG. 6, and accordingly is located in the flow of material lifted by the cylinder 10 and deposited into the trough 14. The cute 35 slopes downwards towards an opening 36 in the trough 14 which forms an entrance to a compartment 37 mounted to the outside of the trough 14. This compartment has a sloping bottom wall 38 and a bottom opening 39, and below said opening an impingement plate 40 is mounted, which slopes downwards in the longitudinal direction of the trough. The sensor 17 of the type described above is mounted to the impingement plate 40.

Thus, when the separator is operating and contamination particles are forwarded to the trough 14, the flow of such particles is sampled by the chute 35 which diverts a flow of the particles to the compartment 37. The particles fall through the compartment and are directed by the sloping bottom 38 through the opening 39 so as to impinge onto the plate 40, such impingement being registered by the sensor 17 in the manner previously described. The sensor is connected to a terminal box 41 from which a cable 42 is extended through the shaft 27 to the electronic function unit 18 for processing of the signals in the manner described and controlling of the flow to the separator such that optimal operation thereof is obtained.

In FIG. 5, two further chutes 35' and 35'' are shown and each of these chutes are associated with a sensor in the manner described with reference to chute 35. The sensor are connected to the unit 18 as mentioned above.

We claim:

1. Length separator comprising at least one rotatable member being indented to form a plurality of cells for lifting seed and other particles from a lower position to a higher position, a trough extending longitudinally of the rotatable member for receiving the seeds and particles lifted by means of the rotatable member, a plurality of sensor distributed along the trough in the longitudinal direction thereof to sense the flow of lifted material supplied to the trough at different locations along the trough by generating electric signals in response to actuation of one of said sensors by particles leaving the rotatable member and falling down into the trough, an electronic function unit including means for comparing the signals obtained from the sensors with a mathematic model having predetermined desired parameters and representing the distribution of the separated material over the length of the trough, and adjustment means for adjusting the flow of material supplied to the separator, the electronic function circuit being connected to the adjusting means to maintain the throughput within said parameters along said trough where sensors are located.

2. A separator as in claim 1 further comprising means for diverting a proportion of the flow of lifted material supplied to the trough, and for directing said proportion of the flow toward one of said sensors.

3. A separator as in claim 2 wherein said diverting means comprises a chute projecting into the flow of lifted material supplied to the trough.

* * * * *

UNITED STATES PATENT AND TRADEMARK OFFICE

CERTIFICATE OF CORRECTION

PATENT NO. : 4,722,445

DATED : 2 February 1988

INVENTOR(S) : Thomas Edholm and Ulf Stahl

It is certified that error appears in the above-identified patent and that said Letters Patent is hereby corrected as shown below:

Column 1, line 9, "on" should be --one--.

Column 1, line 17, "ssed" should be --seeds--.

Column 1, line 25, "efficience" should be --efficiency--.

Column 1, line 60, "for" (first occurrence) should be --to--.

Column 2, line 31, "incident" should be --indent--.

Column 2, line 33, "indentation" should be --indentations--.

Column 3, line 13, "electrical" should be --electric--.

Column 4, line 18, delete "the" (second occurrence).

Column 4, line 29, "positon" should be --position--.

Column 4, line 44, "paremeters" should be --parameters--.

Column 5, line 5, "a" should be --an--.

Column 6, line 9, "sensor" should be --sensors--.

Column 6, line 17, "sensor" should be --sensors--.

Signed and Sealed this

Twenty-sixth Day of July, 1988

*Attest:*

DONALD J. QUIGG

*Attesting Officer*

*Commissioner of Patents and Trademarks*